US009731395B1

(12) United States Patent
Dovel

(10) Patent No.: US 9,731,395 B1
(45) Date of Patent: Aug. 15, 2017

(54) TILTED ANGLE ABRASIVE BELT SHARPENER

(71) Applicant: Darex, LLC, Ashland, OR (US)

(72) Inventor: Daniel T. Dovel, Shady Cove, OR (US)

(73) Assignee: Darex, LLC, Ashland, OR (US)

( * ) Notice: Subject to any disclaimer, the term of this patent is extended or adjusted under 35 U.S.C. 154(b) by 0 days.

(21) Appl. No.: 15/430,222

(22) Filed: Feb. 10, 2017

Related U.S. Application Data

(60) Provisional application No. 62/294,351, filed on Feb. 12, 2016.

(51) Int. Cl.
*B24B 3/54* (2006.01)
*B24B 23/06* (2006.01)

(52) U.S. Cl.
CPC ..... *B24B 3/54* (2013.01); *B24B 23/06* (2013.01)

(58) Field of Classification Search
CPC ..... B24B 3/54; B24B 23/06
USPC ..... 451/302
See application file for complete search history.

(56) References Cited

U.S. PATENT DOCUMENTS 2,124,593 A * 7/1938 Schaefer ..... B24B 3/54 451/194
2,222,361 A * 11/1940 Burns ..... B24B 3/54 451/302
2,249,218 A 7/1941 Meade et al.
2,341,068 A * 2/1944 Zummach ..... B24B 3/54 451/302
4,964,241 A 10/1990 Conklin
5,957,758 A * 9/1999 Shrum ..... B24B 21/18 451/59
6,648,737 B2 * 11/2003 Deware ..... B24B 23/06 451/297
8,696,407 B2 * 4/2014 Dovel ..... B24B 3/52 451/296
8,784,162 B1 * 7/2014 Dovel ..... B24B 3/54 451/303
8,944,894 B2 2/2015 Smith et al.
2004/0198198 A1 10/2004 Friel, Sr. et al.
2008/0261494 A1 10/2008 Friel et al.
2011/0201257 A1 8/2011 Walker
2014/0057537 A1 * 2/2014 Menegon ..... B24B 3/54 451/302
2015/0343591 A1 * 12/2015 Dovel ..... B24B 3/36 451/349

* cited by examiner

*Primary Examiner* — George Nguyen
(74) *Attorney, Agent, or Firm* — Hall Estill Attorneys at Law

(57) ABSTRACT

A sharpener for sharpening a cutting tool having a blade portion with a cutting edge, such as but not limited to a kitchen knife. In some embodiments, the sharpener has first and second rollers, with the first roller rotatable about a first roller axis and the second roller rotatable about a second roller axis parallel to the first roller axis. An endless abrasive belt is arranged along a belt path that passes over the first and second rollers to define a planar segment that lies along a neutral plane from the first roller to the second roller. A guide assembly adjacent the planar segment of the belt is configured to contactingly engage the cutting edge of the cutting tool and apply a non-uniform surface pressure to a side of the cutting tool adjacent the cutting edge across a width of the belt.

20 Claims, 10 Drawing Sheets

TILTED ANGLE ABRASIVE BELT SHARPENER

RELATED APPLICATION

The present application makes a claim of domestic priority under 35 U.S.C. 119(e) to U.S. Provisional Patent Application No. 62/294,351 filed Feb. 12, 2016, the contents of which are hereby incorporated by reference.

BACKGROUND

Cutting tools are used in a variety of applications to cut or otherwise remove material from a workpiece. A variety of cutting tools are well known in the art, including but not limited to knives, scissors, shears, blades, chisels, machetes, saws, drill bits, etc.

A cutting tool often has one or more laterally extending, straight or curvilinear cutting edges along which pressure is applied to make a cut. The cutting edge is often defined along the intersection of opposing surfaces (bevels) that intersect along a line that lies along the cutting edge.

In some cutting tools, such as many types of conventional kitchen knives, the opposing surfaces are generally symmetric; other cutting tools, such as many types of scissors and chisels, have a first opposing surface that extends in a substantially normal direction, and a second opposing surface that is skewed with respect to the first surface.

Complex blade geometries can be used, such as multiple sets of bevels at different respective angles that taper to the cutting edge. Scallops or other discontinuous features can also be provided along the cutting edge, such as in the case of serrated knives.

Cutting tools can become dull over time after extended use, and thus it can be desirable to subject a dulled cutting tool to a sharpening operation to restore the cutting edge to a greater level of sharpness. A variety of sharpening techniques are known in the art, including the use of grinding wheels, whet stones, abrasive cloths, abrasive belts, etc.

SUMMARY

Various embodiments of the present disclosure are generally directed to a sharpener for sharpening a cutting tool having a blade portion with a cutting edge, such as but not limited to a kitchen knife.

In some embodiments, the sharpener has first and second rollers, with the first roller rotatable about a first roller axis and the second roller rotatable about a second roller axis parallel to the first roller axis. An endless abrasive belt is arranged along a belt path that passes over the first and second rollers to define a planar segment that lies along a neutral plane from the first roller to the second roller. A guide assembly adjacent the planar segment of the belt is configured to contactingly engage the cutting edge of the cutting tool and apply a non-uniform surface pressure to a side of the cutting tool adjacent the cutting edge across a width of the belt.

In some embodiments, the non-uniform surface pressure is established by inducing tilt in the cutting edge relative to the belt. In other embodiments, the non-uniform surface pressure is established by inducing skew in the cutting edge relative to the belt. In yet further embodiments, the non-uniform surface pressure is established by using a support member which supports the belt in a position near the application of the cutting tool to the belt, the support member inducing localized skew of the belt.

These and other features and advantages of various embodiments can be understood with a review of the following detailed description in conjunction with the accompanying drawings.

DETAILED DESCRIPTION

Figure 1:
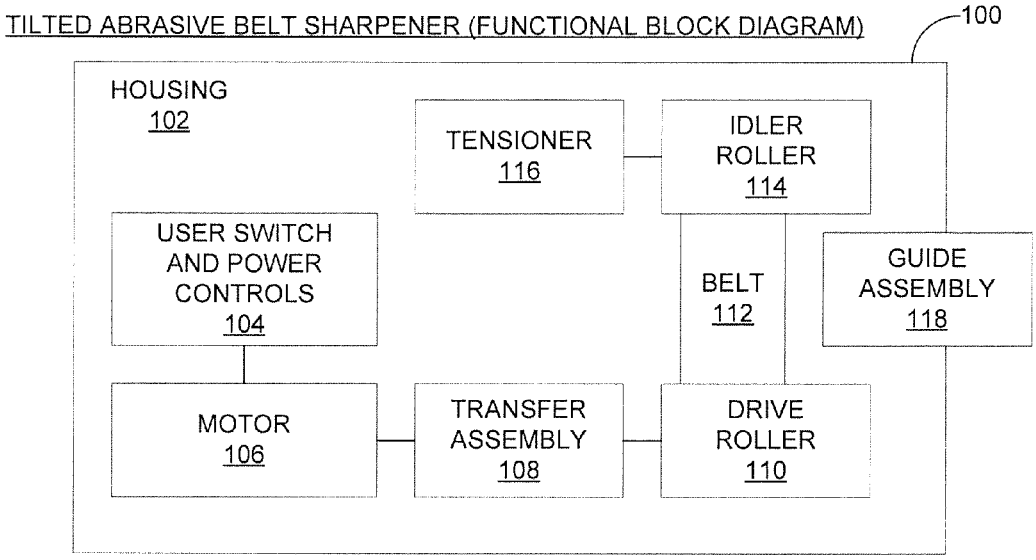
FIG. 1 provides a functional block diagram for a tilted angle abrasive belt sharpener constructed and operated in accordance with various embodiments of the present disclosure.

Generally, so-called slack belt sharpening techniques can be used to sharpen the cutting edge of a cutting tool, such as a knife, using a power-driven endless abrasive belt. One non-limiting example of a slack belt powered sharpener is provided in U.S. Pat. No. 8,696,407, assigned to the assignee of the present application.

As discussed more fully in the '407 patent, slack belt sharpening generally involves using an unsupported expanse of abrasive belt to contactingly engage a cutting edge of a knife or other cutting tool at an appropriate presentation (bevel) angle to deform a portion of the belt out of a neutral plane (e.g., a planar extent of the belt extending between a pair of belt supports, such as rollers). The deflection of the belt generally induces a small twisting effect in relation to curvilinear changes in the cutting edge along the length of the knife.

In this way, a user can draw the cutting edge across the moving belt and the belt will automatically adjust to follow the contour of the cutting edge as it removes material along the blade portion of the knife. By applying respective sharpening operations to opposing sides of the blade, a sharpened cutting edge can be efficiently produced.

While operable, one limitation that has been found with these and other forms of slack-belt sharpeners is a non-uniform amount of material removal along the length of the blade (e.g., so called material take off, or MTO rate). Certain types of cutting tools, such as kitchen ("chef") knives, tend to have a curvilinearly extending cutting edge with relatively small amounts of curvature near a handle of the knife and increasingly greater amounts of curvilinearity near the tip of the blade. In such knives, it has been found that the unsupported segment of the belt can tend to remove too little material at the base of the blade near the handle, and too much material near the tip. One factor that induces this variation is the amount of deflection (twist) induced in the belt; generally, the greater the deflection, the higher the localized surface pressure and higher the corresponding MTO rate.

It follows that some belt sharpening operations can result in a rounding of the tip of the blade rather than retaining the tip as a sharp, well defined point, as well as incomplete sharpening of the cutting edge immediately adjacent the handle. While the user may be able to mitigate these and other effects through controlled presentation and withdrawal of the blade across the belt, various embodiments of the present disclosure present a number of operative features that can promote easier, more consistent abrasive belt sharpening that reduces such variations in surface pressure and corresponding MTO rates during a sharpening operation.

As explained below, such features include the use of what is collectively and/or variously referred to herein as "tilted angle abrasive belt sharpening." Generally, tilted angle abrasive belt sharpening, also referred to as "modified slack belt sharpening," refers to a novel sharpener configuration and methodology that purposefully induces a selected non-orthogonal alignment between the cutting edge of the knife or other cutting tool with respect to the abrasive belt in order to better control surface pressures and corresponding MTO rates across the width of the belt. A variety of different approaches can be used to achieve this tilted sharpening effect.

In some embodiments, a presentation angle of the knife or other cutting tool is fixed at a selected non-orthogonal angle with respect to the axis of one or more rollers along which the endless abrasive belt is driven. This may be carried out by tilting the belt path in a "backward" direction so that the top of the belt path is moved in a direction away from the user and using a substantially horizontal set of edge guides to support the presentation of the tool. Another way in which the non-orthogonal angle can be established is by skewing the presentation angle of the knife inwardly with respect to the belt. Yet another way the non-orthogonal angle can be established is through the use of a backing support member the supports the belt in the vicinity of the contact zone. These respective approaches can be combined or used individually.

In each of these cases, surface pressures and corresponding MTO rates are controlled to enhance the sharpening process. Depending on the configuration, greater surface pressures and higher MTO rates can be supplied to the front edge of the belt (e.g., closer to the user or adjacent a proximal end of the tool) and lower surface pressures and lower MTO rates can be supplied to the rear edge of the belt (e.g., farther from the user or adjacent a distal end of the tool).

These and other features and advantages of various embodiments of the present disclosure can be understood beginning with a review of FIG. 1 which shows a functional block diagram of a tilted angle abrasive belt sharpener 100. An initial overview of various operative elements of the sharpener 100 will enhance an understanding of various sharpening geometries established by the sharpener which will be discussed below. It will be appreciated that sharpeners constructed and operated in accordance with various embodiments can take various forms so that the particular elements represented in FIG. 1 are merely for illustrative purposes and are not limiting.

The exemplary sharpener 100 is configured as a powered sharpener designed to rest on an underlying horizontal base surface, such as a table top, and to be powered by a source of electrical power such as residential or commercial alternating current (AC) voltage, a direct current (DC) battery pack, etc. Other forms of tilted angle abrasive belt sharpeners can be implemented, including hand-held sharpeners, non-powered sharpeners, etc. that employ the various features disclosed herein.

The sharpener 100 includes a rigid housing 102 that may be formed of a suitable rigid material such as but not limited to injection molded plastic. A user switch and power control module 104 includes one or more user operable switches (e.g., power, speed control, etc.) and power conversion circuitry to transfer electrical power to an electrical motor 106.

The motor 106 induces rotation of a shaft or other coupling member linked to a power transfer assembly (PTA) 108, which may include various mechanical elements such as gears, linkages, etc. which, in turn, impart rotation to one or more drive rollers 110. It is contemplated albeit not necessarily required that the drive roller 110 will rotate at a steady state rotational velocity during powered operation of the sharpener.

An endless abrasive belt 112 extends about the drive roller 110 and at least one additional idler roller 114. In some cases, multiple rollers may be employed by the sharpener, such as three or more rollers to define a segmented belt path. A tensioner 116 may impart a bias force to the idler roller 114 to supply a selected amount of tension to the belt. A guide assembly 118 is configured to enable a user to present a cutting tool such as a knife against a segment of the belt 112 between the respective rollers 110, 114 along a desired presentation orientation, as discussed below.

Figure 2A:
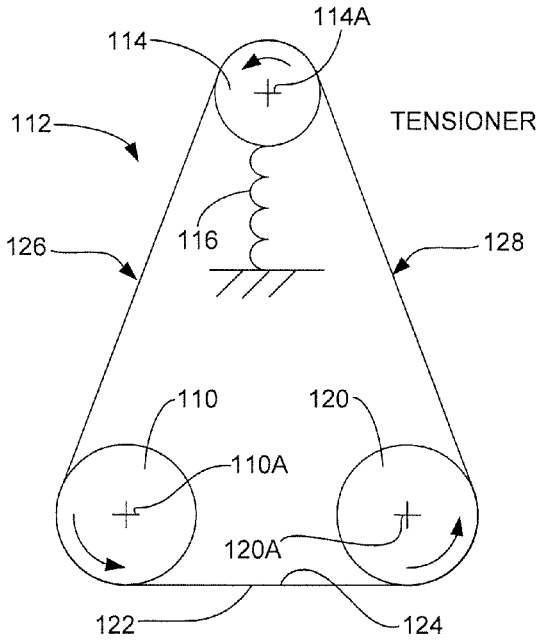
FIG. 2A is a schematic depiction of aspects of the sharpener of FIG. 1.

A schematic representation of the belt path is provided in FIG. 2A in accordance with some embodiments. A generally triangular path is established for the belt 112 through the use of three rollers: the drive roller 110 in the lower left corner, the idler roller 114 at the top of the belt path, and a third roller 120 which may also be an idler roller. It will be appreciated that any number of belt paths can be established using any suitable corresponding numbers and sizes of rollers as desired so that a triangular path is used in some embodiments, but not others. The tensioner 116 (FIG. 1) is represented as a coiled spring operable upon the idler roller 114 in a direction away from the remaining rollers 110, 120. Other tensioner arrangements can be used including, but not limited to, a tensioner that applies the tension force to lower idler roller 120.

Figure 2B:
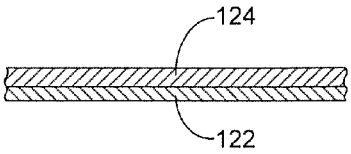
FIG. 2B shows a generalized, cross-sectional representation of the belt from FIG. 2A in greater detail.

The belt 112 has an outer abrasive surface denoted generally at 122 and an inner backing layer denoted generally at 124 that supports the abrasive surface. These layers are shown more fully in FIG. 2B. The relative thicknesses of these respective layers can vary. The abrasive surface 122 includes a suitable abrasive material operative to remove material from the knife during a sharpening operation. The backing layer 124 provides mechanical support and other characteristic features for the belt such as belt stiffness, overall thickness, belt width, etc. The backing layer 124 is configured to contactingly engage the respective rollers 110, 114 and 120 during powered rotation of the belt along the belt path.

The exemplary arrangement of FIG. 2A establishes two respective, elongated planar segments 126, 128 of the belt 112 against which the knife or other cutting tool can be presented for sharpening operations on alternate sides thereof. Segment 126 substantially extends from roller 114 to roller 110, and segment 128 substantially extends from roller 120 to roller 114. Each of the segments 126, 128 normally lies along a neutral plane that is orthogonal to respective rotational axes 110A, 114A and 120A of the rollers 110, 114 and 120.

Each segment 126, 128 is unsupported by a corresponding restrictive backing support member against the backing layer 124. This allows the respective segments to remain aligned along the respective neutral planes in an unloaded state and to be rotationally deflected ("twisted") out of the neutral plane during a sharpening operation through contact with the knife. It is contemplated that one or more support members can be applied to the backing layer 128 in the vicinity of the segments 126, 128, such as in the form of a leaf spring, etc., so long as the support member(s) still enable the respective segments to be rotationally deflected away from the neutral plane during the modified slack-belt sharpening operation. A specially configured support member that provides controlled support to less than the full width of the belt will be discussed below.

Figure 3:
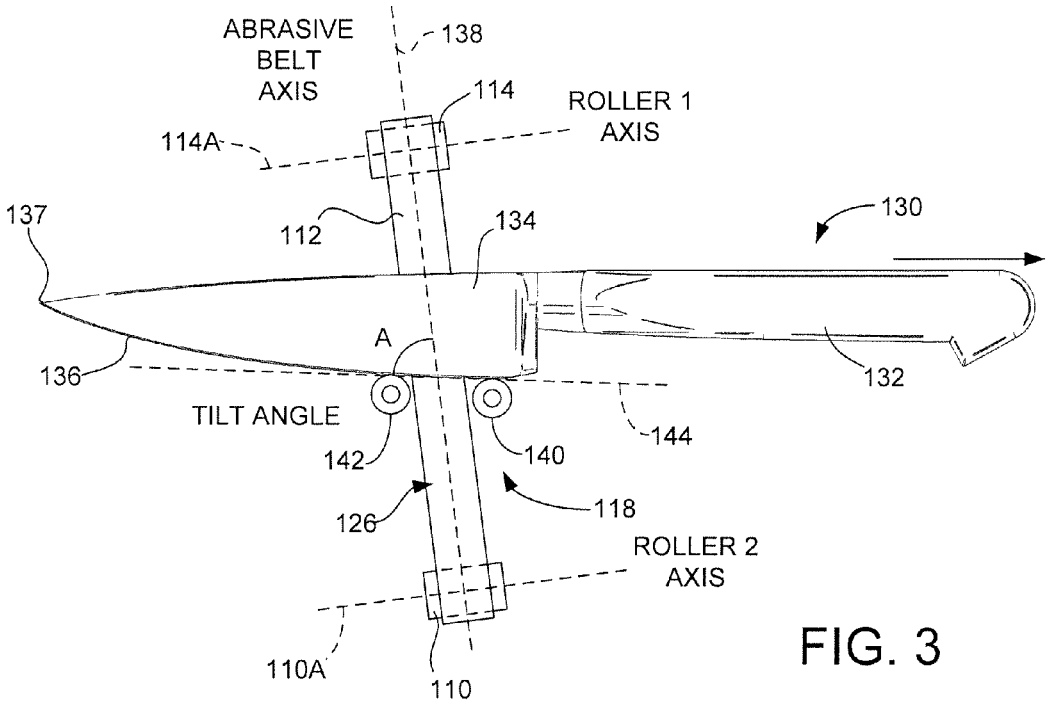
FIG. 3 illustrates a tilt angle mechanism of the sharpener of FIG. 1 that imparts a tilted angle sharpening operation upon a kitchen knife in accordance with some embodiments.

FIG. 3 shows aspects of the exemplary sharpener 100 in accordance with some embodiments. A cutting tool 130, in the form of a kitchen (or chef) knife, is presented against the segment 126 of the belt 112 between rollers 110, 114. The knife 130 includes a user handle 132 and a blade 134 with a curvilinearly extending cutting edge 136. The cutting edge 136 extends to a distal tip 137 and is formed along the intersection of opposing sides (not numerically denoted) of the blade 134 which taper to a line. Removal, honing and/or alignment of material from the respective sides of the blade 134 operate to produce a sharpened cutting edge 136 along the entire length of the blade.

An abrasive belt axis is represented by broken line 138 and indicates a direction of travel and alignment of the belt 112 during operation. The abrasive belt axis 138 is nominally orthogonal to the respective roller axes 110A, 114A of rollers 110, 114 (identified in the drawing as Roller Axes 1 and 2).

A pair of edge guide rollers are represented at 140, 142. The edge guide rollers form a portion of the aforementioned guide assembly 118 (see FIG. 1), and can be made of any suitable material designed to support portions of the cutting edge 136. Other forms of edge guides can be used, including stationary edge guides as discussed below.

Generally, the edge guide rollers 140, 142 provide a retraction path 144 for the blade 134 as the user draws the cutting edge across the belt 112 via the handle 132. The retraction path 144 is non-orthogonal to the abrasive belt axis 138. The intervening angle between lines 138 and 144 is referred to herein as a tilt angle, and is denoted in FIG. 3 as angle A.

Figure 4:
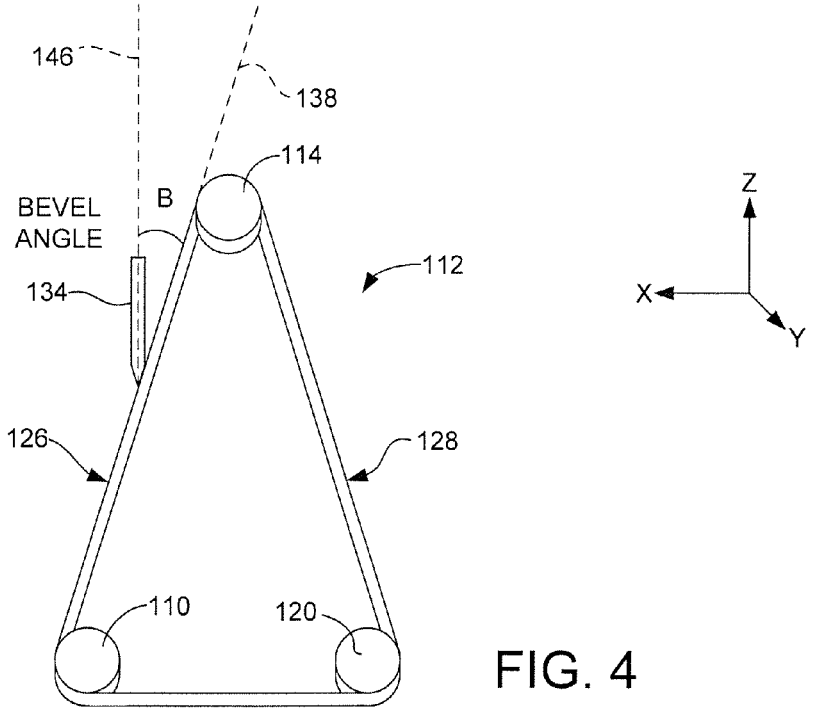
FIG. 4 illustrates a bevel angle imparted to the kitchen knife by the tilt angle mechanism of FIG. 3 in accordance with some embodiments.

A second angle, referred to herein as a bevel angle, is represented as angle B in FIG. 4. Generally, the bevel angle B represents the intervening angle between the abrasive belt axis 138 and a lateral centerline of the blade 134, denoted at 146. The tilt angle can be thought of as the relative angle of the cutting edge 136 "across" the belt (see FIG. 3) and the bevel angle can be thought of as the relative angle of the blade 136 "along" the belt (see FIG. 4).

The magnitude of the tilt angle A can vary. In some embodiments, the tilt angle A as defined in FIG. 3 is selected to be less than 90 degrees, such as but not limited to the range of from about 65 degrees to about 89 degrees. This is in contrast to other belt sharpeners, such as but not limited to the sharpener disclosed in the '407 patent mentioned above, which provides a presentation angle of nominally 90 degrees. At this point it will be noted that other formulations for the tilt angle can be used as desired. For example, a review of FIG. 3 shows that the tilt angle can alternatively be defined as the non-orthogonal angle between the presentation line 144 and the respective roller axes 110A, 114A (e.g., the complementary angle to angle A). Using this alternative formulation, the tilt angle may be on the order of from about 1 degree to about 25 degrees.

The magnitude of the bevel angle B can also vary. In some embodiments, the bevel angle B is selected to be in the range of from about 5 to about 15 degrees. The bevel angle generally determines the side geometry of the blade adjacent the cutting edge. For clarity, it will be appreciated that the conformal nature of the belt 112 will tend to impart a convex curvilinear shape to the side of the cutting edge rather than a flat "bevel" shape. Nevertheless, the term "bevel" is useful in generally denoting the relative orientation between the belt extent 126 and the blade 134.

The non-orthogonal tilt angle A is selected to reduce the deflection of the rear edge of the belt (e.g., that portion of the belt farthest from the handle) and to increase the deflection of the front edge of the belt (e.g., that portion of the belt closest to the handle). Tilting the belt with respect to the blade such as exemplified in FIG. 3 provides a more uniform average surface pressure across the length of the cutting edge 136 from the handle 132 to the tip 137.

Referring again to FIG. 3, it will be noted that the edge guide rollers 140, 142 define the presentation line 144 so as to be nominally horizontal (e.g., along the X-Y plane), and the belt is tilted forward so that the respective roller axes 110A, 114A are skewed with respect to the horizontal direction. This allows the user to present the knife 130 in a substantially horizontal fashion as the knife is drawn across the belt. This arrangement is merely illustrative and is not limiting. In other embodiments, these respective elements may be rotated such that the belt 112 is vertical (e.g., roller axes 110A and 114A are horizontally disposed and the belt extends along the X-Z plane), and the edge guide rollers 140, 142 are adjusted so that the presentation line 144 extends upwardly in a non-horizontal fashion. In this latter case, the user may draw the knife across the belt such that the handle 132 is relatively lower and the tip 137 is relatively higher above a horizontal base surface on which the sharpener rests. Other arrangements may be used as well.

Figure 5:
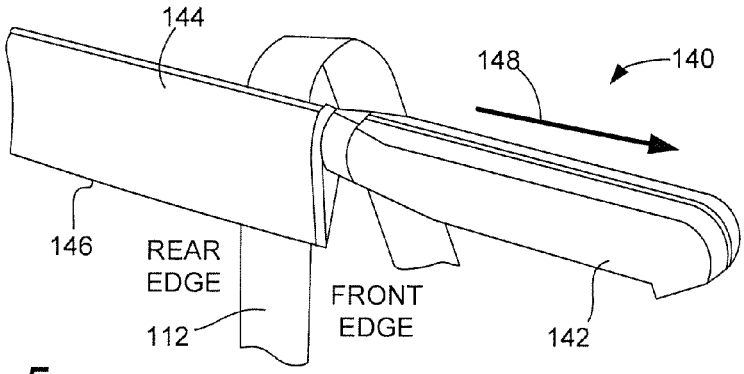
FIG. 5 is an isometric depiction of the relative arrangement of the kitchen knife and the belt of FIGS. 3-4.

FIG. 5 is an isometric depiction of another knife 140 adjacent the belt 112. The knife 140 is similar to the knife 130 discussed above and includes a handle 142, blade 144 and cutting edge 146. During sharpening, the cutting edge 146 is drawn across the belt 112 in direction 148. Respective front and rear edges of the belt are denoted with respect to this direction. It will be recalled that the front edge of belt is that portion of the width of the belt closest to the handle 142, and the rear edge is that portion of the width of the belt farthest away from the handle.

Figure 6A:
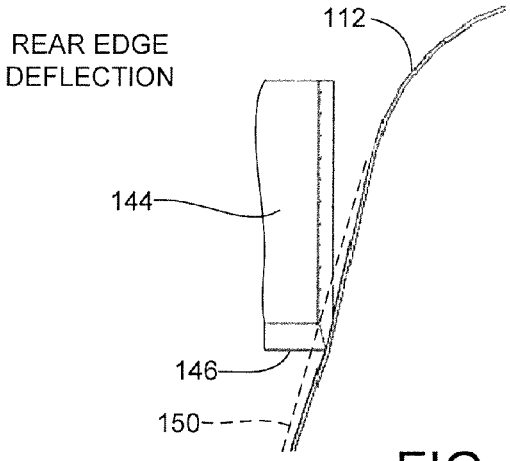
FIGS. 6A and 6B illustrate different relative amounts of belt deflection adjacent rear and front edges of the belt, respectively, induced by the tilt belt mechanism shown in FIG. 3.
Figure 6B:
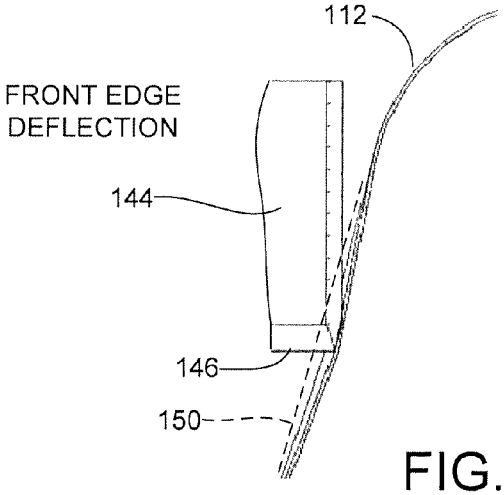

FIG. 6A is a cross-sectional representational view of the rear edge deflection encountered by the belt. FIG. 6B shows a corresponding cross-sectional representational view of the front edge deflection encountered by the belt. Dotted line 150 represents the neutral plane along which the belt 112 normally lies in the absence of the knife 140 or other cutting tool.

From FIGS. 6A and 6B it can be seen that a larger amount of deflection (twist) is incurred at the front edge of the belt as compared to the rear edge. The tilt angle and the width of the belt will influence the difference between the front and rear deflection. This difference can be optimized for a specific belt/abrasive combination as well as for the shape of the blade being sharpened. Generally, decreasing the tilt angle A (see FIG. 3) and/or increasing the belt width will tend to increase the difference between the front and rear deflection amounts. This in turn will adjust the relative surface pressure and MTO rates at the front and rear edges.

The particular configuration of the sharpener 100 (see FIG. 1) can be arranged to achieve the desired tilt and bevel angles. As noted above, the belt and rollers can be "canted" within the interior of the housing 102 so that a user presents the knife (or other cutting tool) via the guide assembly 118 in a substantially horizontal orientation, as generally depicted in FIGS. 3-4. In other embodiments, the belt and rollers can be nominally vertically aligned within the housing 102 and the user can present the knife against the guide assembly 118 at an elevated, non-horizontal orientation. These and other considerations are well within the ability of the skilled artisan to implement depending on the requirements of a given application.

Figure 7A:
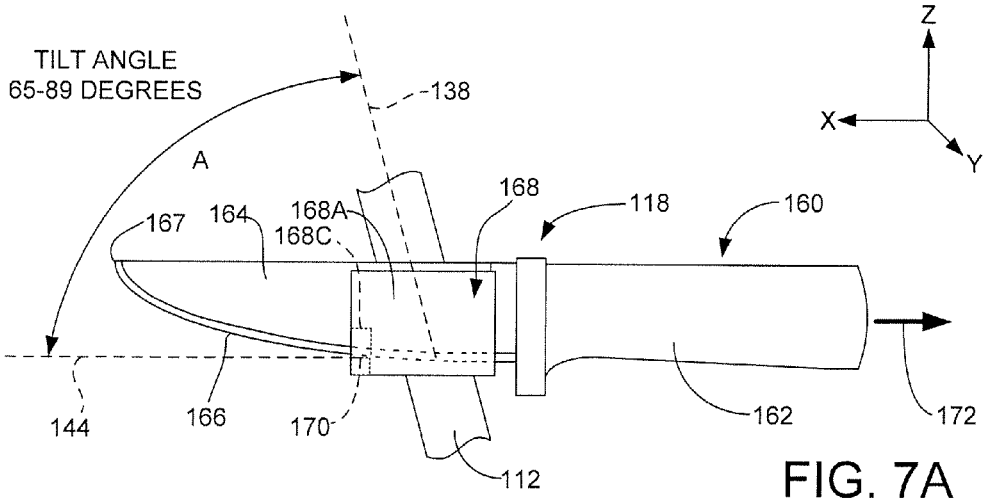
FIGS. 7A through 7E show aspects of an alternative tilt belt mechanism in accordance with further embodiments.
Figure 7B:
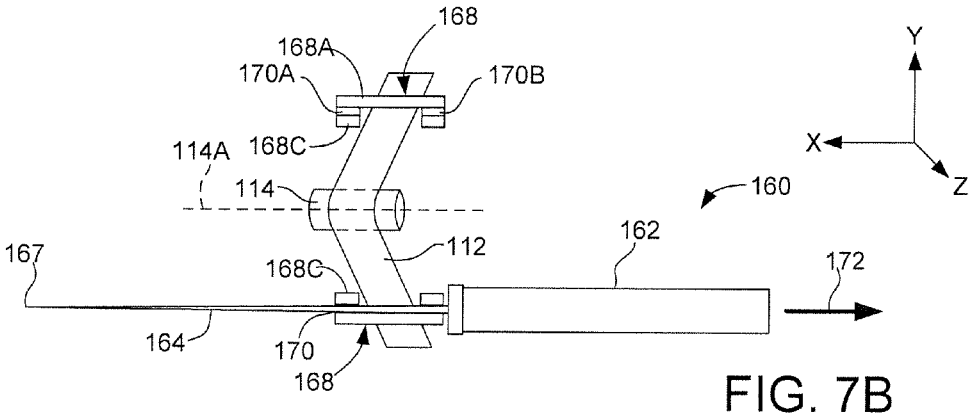

FIGS. 7A through 7E illustrate aspects of the sharpener 100 of FIG. 1 in accordance with further embodiments. A knife 160 includes a handle 162, blade 164 and cutting edge 166 which tapers to a point 167. The aforementioned guide assembly 118 includes a guide member 168 which provides a guide surface in facing relation to the belt 112 to facilitate alignment of the blade 164 thereagainst. A stationary edge support surface 170 allows the user to support a portion of the cutting edge 166 as the user withdraws the blade across the belt 112 in direction 172. It will be noted that a single edge guide surface 170 can be used as illustrated in FIG. 7A, or multiple edge guide surfaces 170A, 170B can be utilized as illustrated in FIG. 7B.

The relative tilt angle A between the guide 168 and the belt 112 is contemplated as extending from about 65 degrees to about 89 degrees, as indicated in FIG. 7A. Other angles can be used so long as the tilt angle is nominally non-orthogonal to an axis associated with the belt path (e.g., belt axis, roller axis).

As noted above, an alternative way to define the non-orthogonal tilt angle A is to state that the retraction path line 144 is non-parallel with the associated roller axes that support the segment of belt against which the knife is drawn (see e.g., roller axes 110A, 114A in FIG. 3). Using this latter formulation, the tilt angle range of 65-89 degrees between lines 138, 144 would correspond to the complementary angle range of from about 1 to about 25 degrees between line 144 and the roller axes 110A, 114A (see e.g., FIG. 3).

Figure 7C:
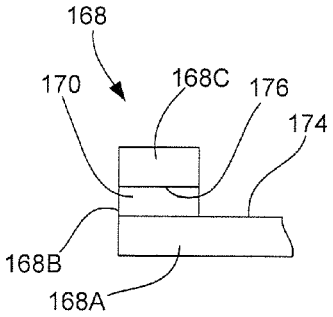
Figure 7D:
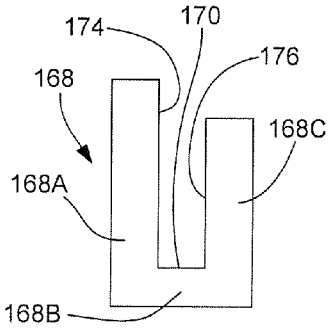

FIG. 7B shows the use of two guides 168 on opposing sides of the topmost roller 114 to enable double sided sharpening operations. FIG. 7C shows a top plan view of a portion of one of the guides 168, and FIG. 7D shows a corresponding elevational view of the guide from FIG. 7C. The guide 168 includes a substantially vertically extending outward portion 168A, a substantially horizontally extending base portion 168B and a substantially vertically extending inward portion 168C.

The aforementioned edge surface 170 extends along the top of portion 168B. An inwardly facing guide surface 174 extends along portion 168A, and an outwardly facing guide surface 176 extends along portion 168C. Surfaces 170, 174 and 176 form a generally u-shaped channel, or guide slot, to accommodate the knife 160. The edge guide surface contactingly supports the cutting edge 166, and the opposing side surfaces can contactingly support the opposing sides of the blade 164. The relative elevation and orientation of the surfaces 170, 174 and 176 are selected with respect to the central axis 138 of the belt 112 (see FIG. 7A) to provide the desired tilt angle. It will be noted that the guide surfaces 174, 176 lie along associated planes each parallel to each of the roller axes 110A, 114A and 120A.

Figure 7E:
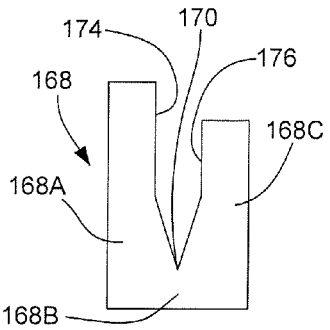

FIG. 7E shows an alternative construction for the guide 168. The respective interior guide surfaces 170, 174 and 176 taper to provide narrowed, substantially v-shaped guide slot. The guide elements 168A-168C may be formed of a suitable non-abrasive cuttable or non-cuttable material to support the cutting tool.

Figure 8A:
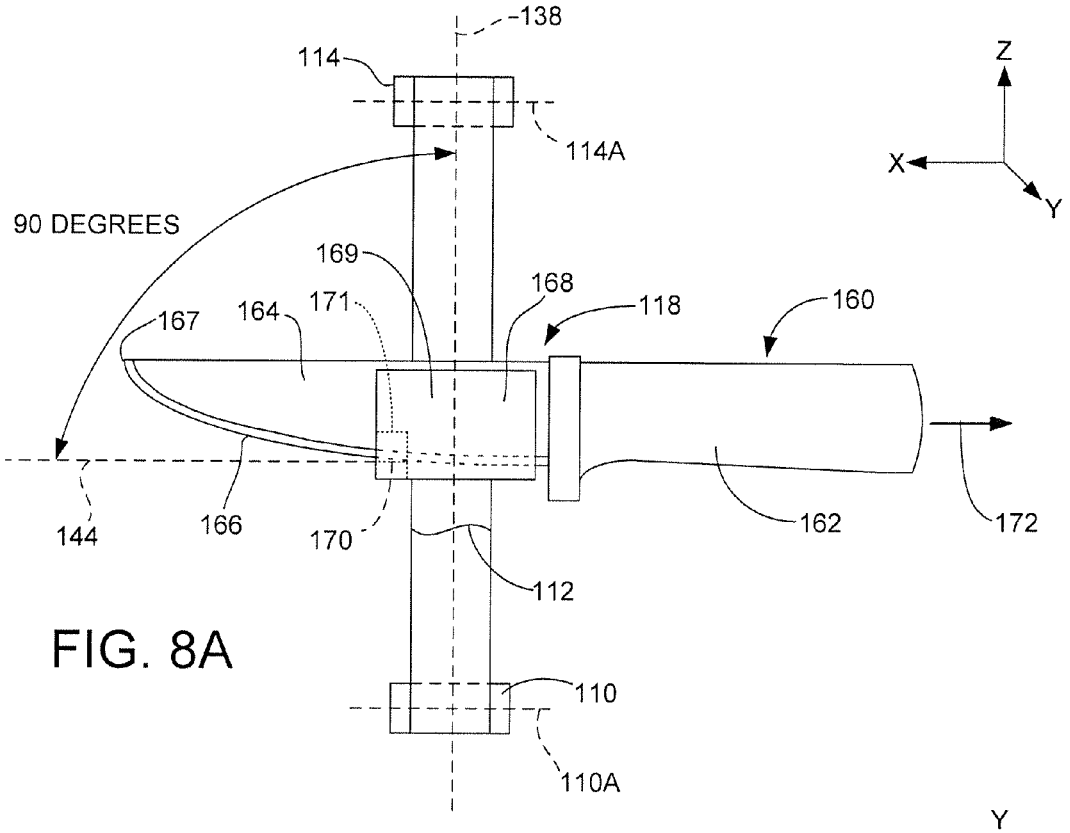
FIGS. 8A and 8B show the knife of FIG. 7 during a sharpening operation with yet another tilt belt mechanism as compared to FIGS. 7A through 7E.
Figure 8B:
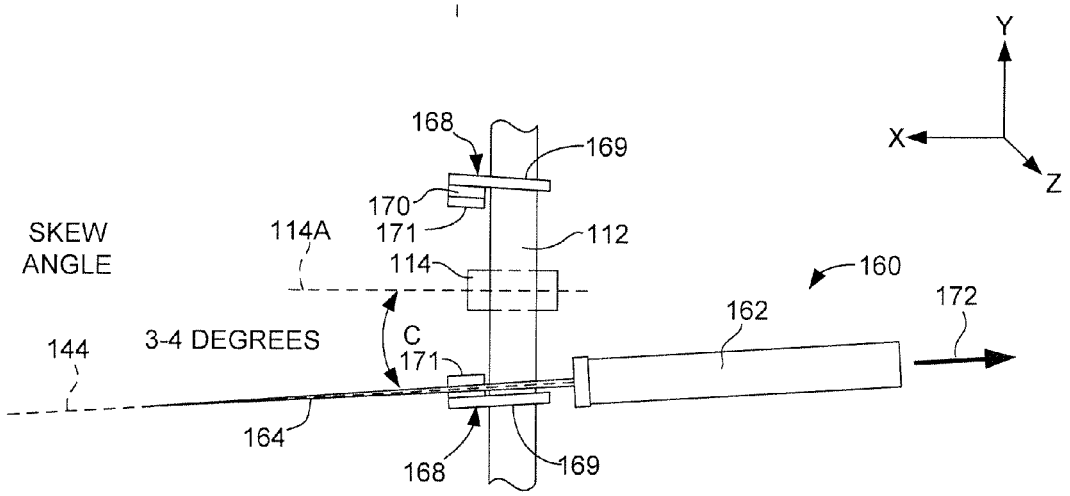

FIGS. 8A and 8B show another embodiment for the sharpener 100 of FIG. 1. Similar elements are identified by like reference numerals from FIGS. 7A-7E. FIG. 8A shows the knife 160 to be aligned in the guide member 168 with the stationary edge guide surface 170 from FIGS. 7C and 7D. In this case, the retraction path line 144 is nominally orthogonal to the belt axis 138 (e.g., nominally 90 degrees), as shown by FIG. 8A.

However, as further shown by the top plan view of FIG. 8B, the guide 168 and edge support surface 170 are skewed with respect to the central axis 114A of the top roller 114 (see FIG. 3) by a skew angle C. Unlike in FIGS. 7A-7E where the tilt angle A is generally along the X-Z plane, the skew angle C in FIGS. 8A-8B is along the X-Y plane. The skew angle C between the axis 114A and the line 144 is on the order of about 3 to about 4 degrees. Other ranges of angles can be used as required.

Further amounts of non-orthogonality can be supplied by combining the arrangement of FIGS. 7A-7B with that of FIGS. 8A-8B; for example, the guide member 168 can be aligned so as to be nonparallel with the axis 114A as in FIG. 8B as well as non-orthogonal to the belt axis 138 as in FIG. 7A. Stated another way, both some measure of tilt angle A and skew angle C can be concurrently imparted by the guide member 168. As before, the guide 168 can use a single edge guide surface 170 (see, e.g., FIG. 8B) or a pair of edge guide surfaces (see e.g., guide surfaces 170A and 170B in FIG. 7B).

While the tilt belt arrangement of FIGS. 8A and 8B can provide similar benefits as an arrangement such as shown in FIGS. 7A and 7B, it will be noted by those skilled in the art that arrangements such as depicted in FIGS. 7A-7B may enable better sharpening at the base of the blade adjacent the handle since larger features (e.g., thumb guards, etc.) proximate the juncture between handle and blade can be more readily accommodated. It is noted that the skewed guides in FIGS. 8A and 8B can take the general configurations shown in FIGS. 7C through 7E except that the respective guides are skewed. For example, the respective guide surfaces 174, 176 would lie along respective planes that intersect (e.g., are non-parallel with) the roller axes 110A, 114A and 120A.

Figure 9A:
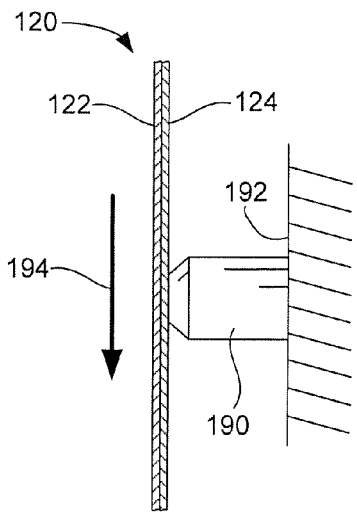
FIGS. 9A and 9B illustrate another tilt belt mechanism that can be used in some embodiments.
Figure 9B:
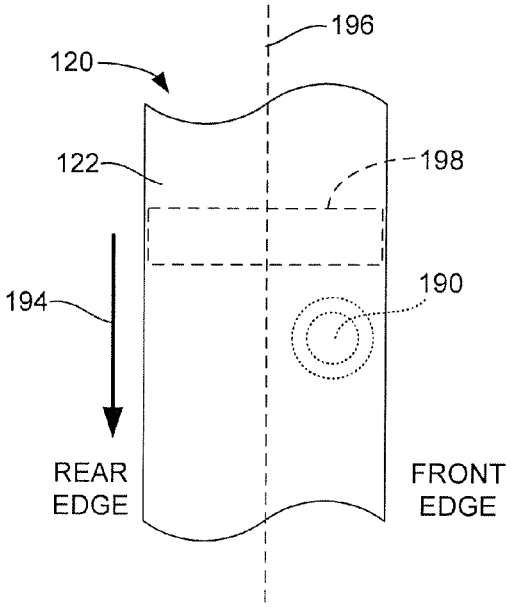

FIGS. 9A and 9B show another configuration of the tilted belt abrasive sharpener 100 of FIG. 1 in accordance with further embodiments. A localized support member 190 is supported by a stationary, rigid base (shown schematically at 192) behind the belt 112. The support member 190 is arranged to contactingly engage and support the backing layer 124 as the belt 112 moves in direction of travel 194. The support member 190 is represented as a cylindrically shaped, tapered pin for clarity of illustration, although any number of different configurations can be used as required.

A suitable low wear material may be used for stationary support members such as 190. Any number of contact shapes can be used (e.g., circular, oval, rectangular, etc). It is contemplated that the support member 190 and base 192 may be incorporated as a portion of the guide assembly used to support the cutting tool (see e.g., guide 168 in FIGS. 7A through 8B).

As further illustrated in FIG. 9B, the support member 190 is offset with respect to a centerline 196 of the belt 112 so as to provide contacting support to the backing layer 124 on only a single side of the centerline, e.g., on the side closest to the handle of the tool (e.g., the front edge of the belt; see FIG. 5). A contact region 198 generally represents that portion of the belt 112 that will nominally contact the side of the tool during the sharpening operation. The location of tool contact is offset (e.g., above) the pin 190. The side of the belt farthest from the handle of the tool (e.g., the rear edge of the belt) remains unsupported.

As the belt serpentines over the pin and adjacent the tool, a greater surface pressure and a higher MTO rate are applied closer to the handle (front edge of the belt or to the right of centerline 196 in FIG. 9B), and a lower surface pressure and a lower MTO rate are applied farther from the handle (rear edge of the belt or to the left of centerline 196 in FIG. 9B).

The relative presentation angle of the tool (see e.g., line 144 in FIG. 3) can be any suitable angle, including orthogonal or non-orthogonal to the belt centerline 196. The support member 190 can thus be used in a stand-alone fashion, or can be added to any of the previous embodiments utilized above.

FIGS. 10A through 10D show yet another embodiment for the tilt angle abrasive belt sharpener 100 of FIG. 1 that is similar to the embodiment of FIGS. 9A and 9B, except that the embodiment of FIGS. 10A-10D uses a rotatable support member 200 ("support roller") that is arranged to rotate about a rotatable roller axis 200A to provide variable surface pressure and MTO rates across the width of the belt 112.

Figure 10A:
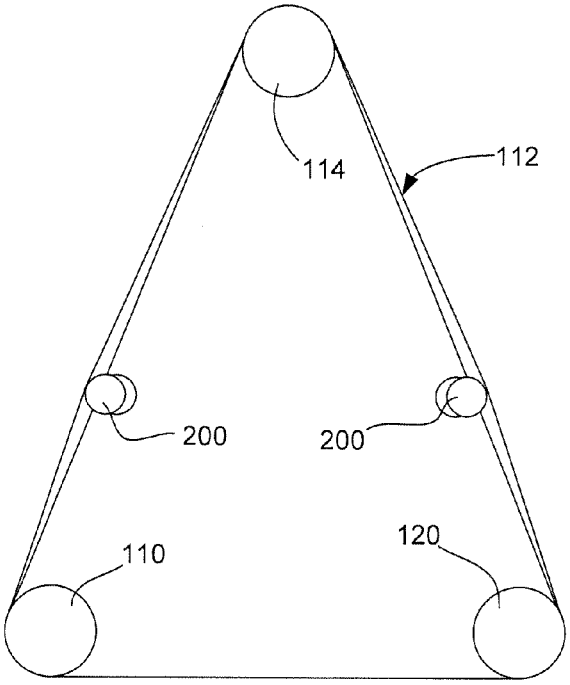
FIGS. 10A through 10D show another tilt belt mechanism similar to the mechanism in FIGS. 9A and 9B in accordance with further embodiments.
Figure 10B:
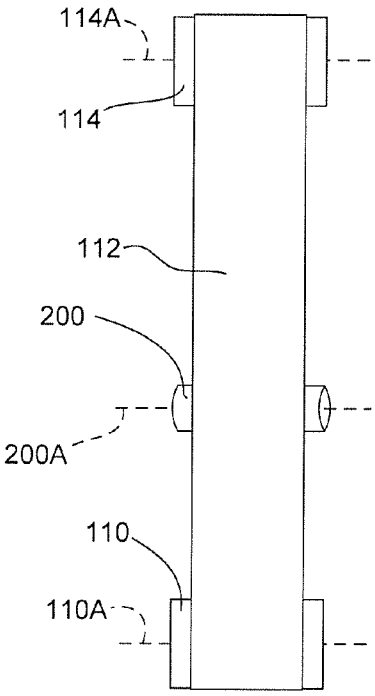
Figure 10C:
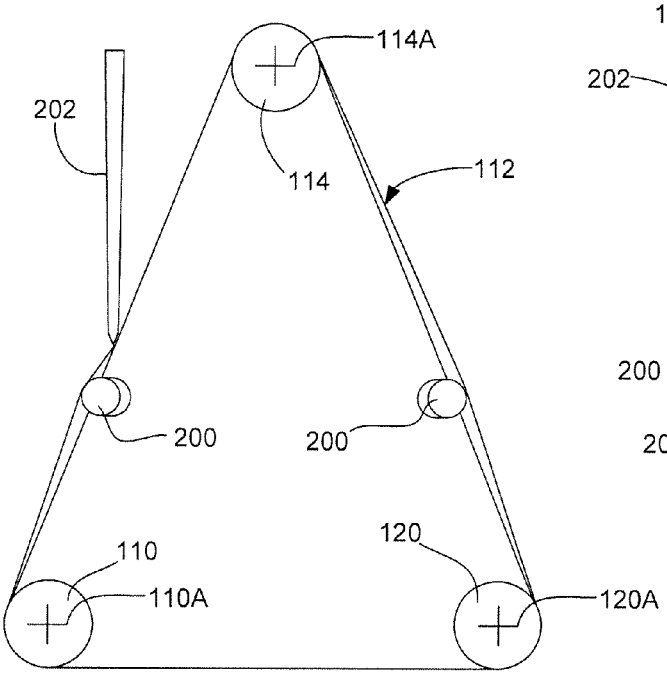
Figure 10D:
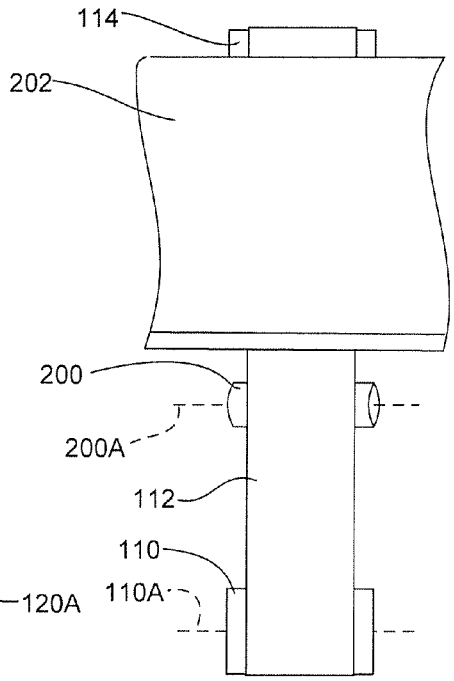

FIGS. 10A and 10B show the sharpener in an unloaded condition. FIGS. 10C and 10D show corresponding views of the sharpener in a loaded condition (e.g., with the presentation of a knife blade 202).

As shown by FIGS. 10A and 10B, two (2) rotatable support rollers 200 are used to provide double sided sharpening configurations in opposing guide slots (not separately shown) in a triangular belt path arrangement similar to that discussed above in FIG. 2A. Each of the rotatable support members 200 is characterized as a cylindrically shaped roller, although other configurations can be used.

For example, in an alternative embodiment, each support member 200 has a tapered (e.g., frusto-conical) shape so that the support varies in a direction toward the rear edge of the belt. Other shapes can be used such as crowned rollers, etc. While the support rollers 200 extend across the full width of the belt 112, this is merely exemplary and is not limiting. In other embodiments, the support rollers 200 may extend less than a full width across the belt.

The roller axes 200A of the support rollers 200 are skewed inwardly from the front edge to the rear edge of the belt so as to be non-parallel with the roller axes 110A, 114A and 120A of the belt rollers 110, 114 and 120. The amount of skew of the support roller axes 200A can vary, but may be on the order of from about 5-15 degrees with respect to the belt roller axes 110A, 114A and 120A. This induces a localized increase in the surface pressure of the belt 112 upon each roller 200 toward the front edge, as depicted by force vectors 204 in FIG. 11A.

Figure 11A:
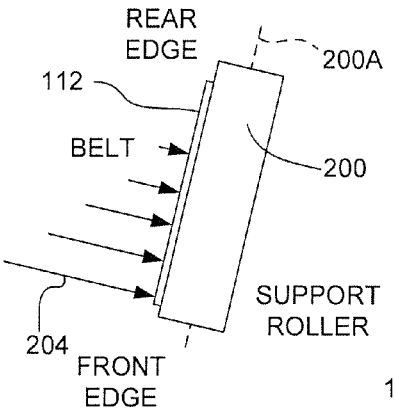
FIGS. 11A through 11C show aspects of the tilt belt mechanism of FIGS. 10A-10D in greater detail.

The force vectors 204 in FIG. 11A represent a variable force that is applied across the width of the belt 112, from a largest amount of force being applied adjacent the front edge and successively smaller amounts of force being applied in a direction away from the front edge and toward the rear edge. The actual extent and rate of change of the applied force in a given system will depend on a number of factors relating to the belt, tensioner, radius and location of the support roller, skew angle of the support roller, etc. For purposes of clarity, it will be noted that the view provided in FIG. 11A is generally a top down view of the left-side support roller 200 (see FIG. 10C) with the belt in cross section at the point of contact against the support roller.

Figure 11B:
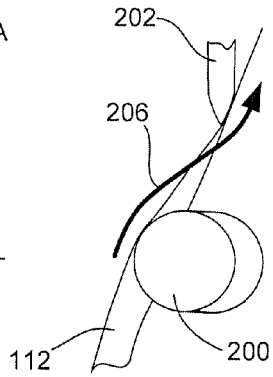

FIG. 11B shows the loaded (e.g., sharpening) condition of FIG. 10C in greater detail. Placing the support roller 200 adjacent and below the contact location for the cutting edge of the knife blade 202 against the belt 112 induces a localized, generally S-shaped serpentine path (indicated generally by path 206) for the belt.

More specifically, this serpentine path 206 is caused by passage of the belt 112 over the skewed support roller 200, which induces a small amount of twist in the belt, with less belt deflection adjacent the front edge of the belt and greater belt deflection adjacent the rear edge of the belt. The belt continues to pass upwardly until the belt encounters the inward side of the knife blade 202. The belt contactingly engages this inward side to perform a sharpening operation upon a cutting edge of the blade. The blade then continues to pass upwardly to upper roller 114A (see FIG. 10C).

Figure 11C:
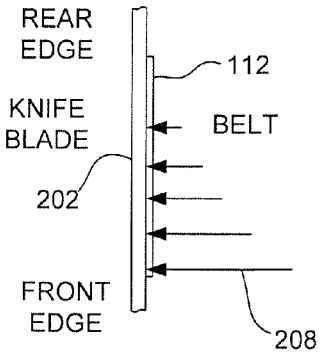

As the belt 112 engages the side of the knife blade 202, the belt induces a variable surface pressure as generally represented by force vectors 208 in FIG. 11C. As before, greater amounts of surface pressure and MTO rate are experienced along the front edge of the belt 112, and these values are reduced across the width of the belt toward the rear edge.

While the serpentine path 206 in FIG. 11B is shown to be traveling generally upwardly in FIG. 11B, it will be appreciated that the same general forces represented in FIGS. 11A and 11C will be experienced if the direction of belt travel is reversed, such as for a sharpening operation applied to the second support roller 200 on the right side of the system diagram in FIG. 10C.

Figure 12A:
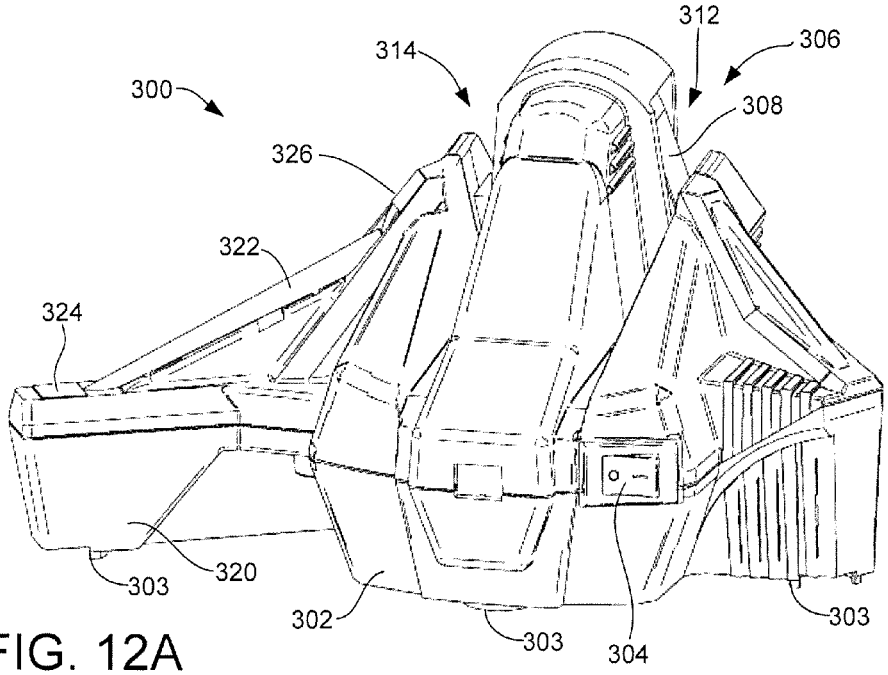
FIGS. 12A through 12D show various views of a tilted angle abrasive belt sharpener similar to the sharpener of FIG. 1 in accordance with further embodiments.
Figure 12B:
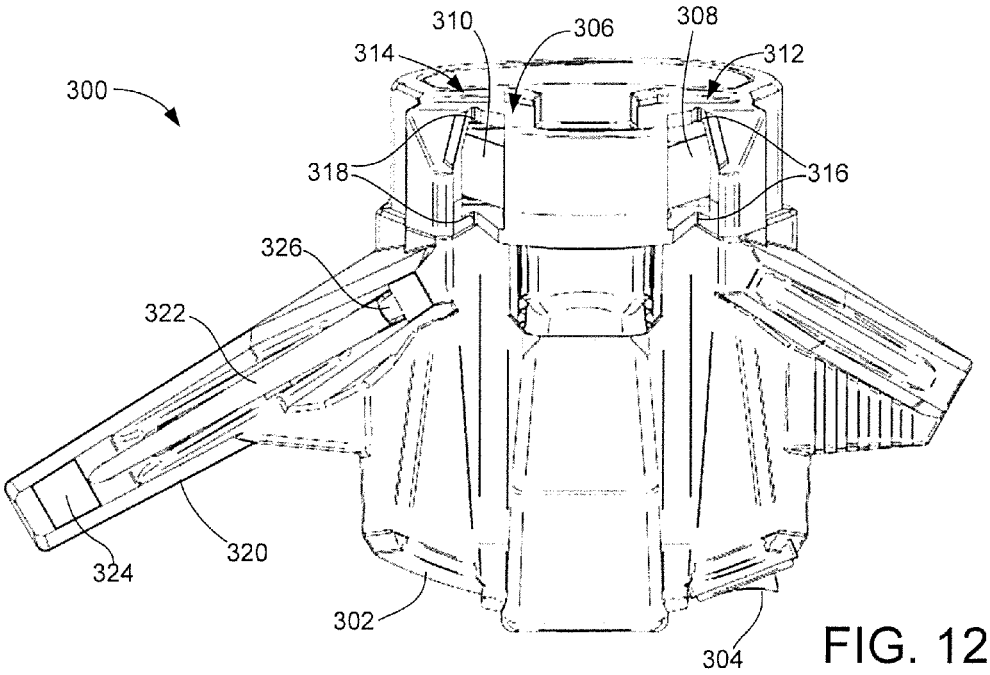
Figure 12C:
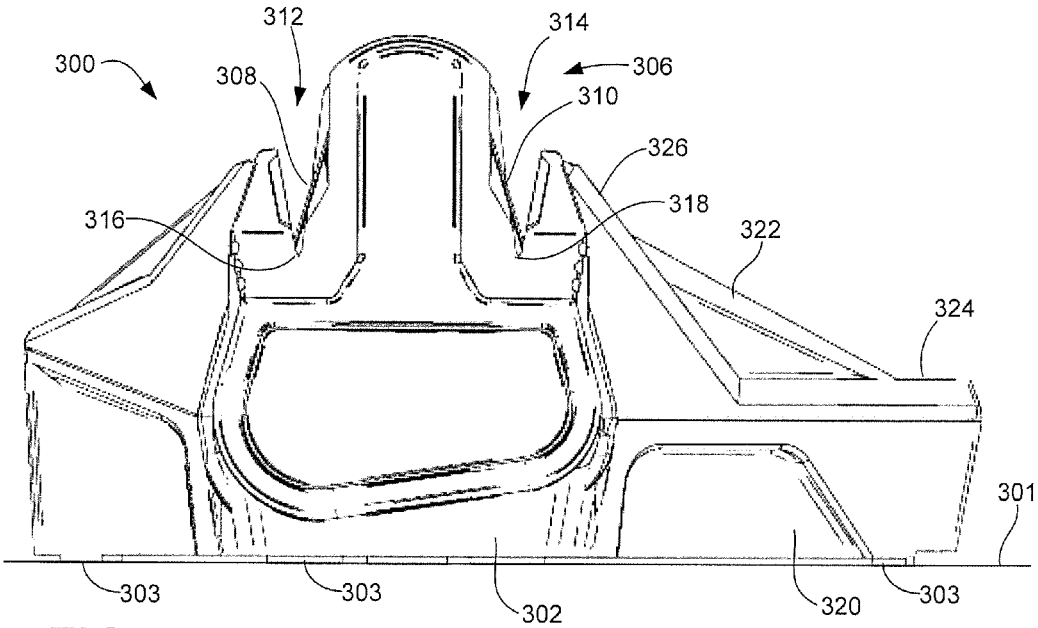
Figure 12D:
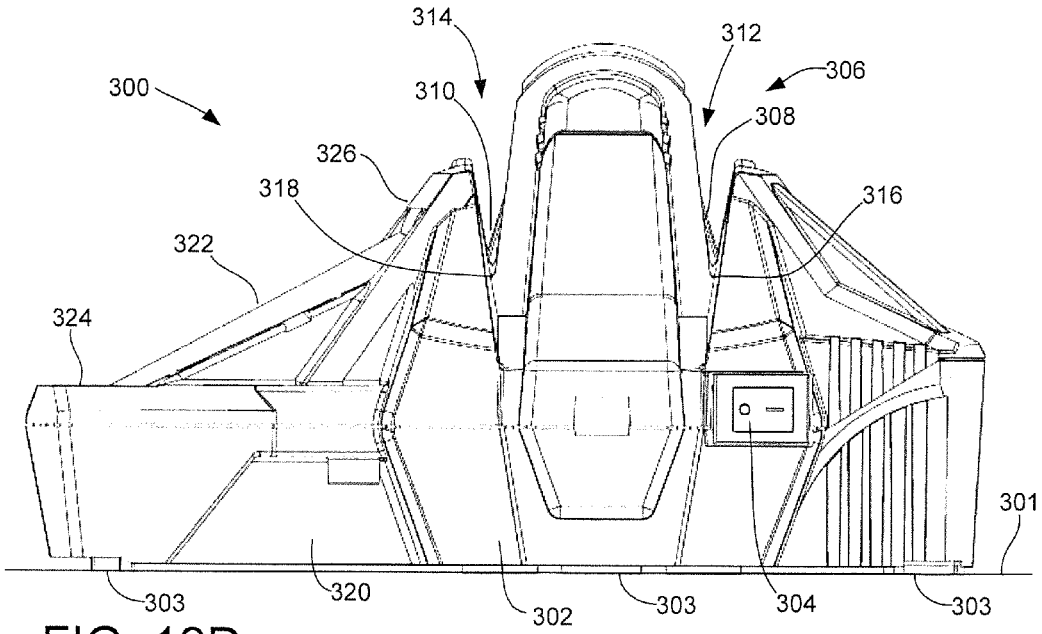

FIGS. 12A through 12D show another tilt angle abrasive belt sharpener 300 in accordance with some embodiments. The sharpener 300 is similar to the sharpener 100 discussed above. FIG. 12A is an isometric view of the sharpener 300. FIG. 12B provides a top plan view, FIG. 12C is a front (user) side view, and FIG. 12D is a rear side view.

The sharpener 300 is a powered combination sharpener configured to rest on a horizontal base surface 301 during operation. As explained below, the sharpener 300 includes an endless abrasive belt that is driven along three rollers in a manner as discussed above in FIG. 2 to provide a triangular belt path. The roller axes are parallel and are each tilted forward in a manner similar to that shown in FIGS. 3 and 4, so that the belt cants forward at a selected non-orthogonal angle A on the order of about 15 degrees (see e.g., FIG. 3).

An internal motor rotates the belt along the belt path. The motor may be mounted at the same tilt angle so that an output drive shaft of the motor is parallel to the roller axes and non-parallel to the horizontal direction. Alternatively, an internal linkage system can be used to link a horizontally disposed motor drive shaft to the non-horizontal roller axes. The sharpener further utilizes stationary guide slots with edge guide surfaces that are arranged in a horizontal fashion, as generally depicted in FIG. 7.

Referring now specifically to FIGS. 12A-12D, the sharpener 300 has a rigid housing 302 formed of a suitable material, such as injection molded plastic, and encloses various elements of interest such as the motor, transfer assembly, rollers, control electronics, etc. The housing 302 includes a plurality of spaced apart base support contact features (e.g., pads) 303 configured to provide stable support of the housing on the underlying horizontal base surface 301. A user activated power on/off switch is shown at 304.

An endless abrasive belt 306 is partially enclosed by the housing 302. Linear extents 308, 310 of the belt are exposed adjacent corresponding guide slots 312, 314 (best viewed in FIG. 12B). The guide slots 312, 314 are substantially v-shaped in a manner similar to that shown above in FIG. 7E and include horizontally aligned, bottom edge surfaces 316, 318 in each of the guide slots 312, 314. The belt 306 is tilted forward approximately 15 degrees with respect to the horizontal base surface 301; stated another way, the roller axes of the rollers disposed within the housing 302 and about which the belt 306 passes are skewed (nonparallel) with the horizontal plane established by the support contact features 303 by about 15 degrees.

To sharpen a cutting tool such as a kitchen knife, the user activates the sharpener 300 using the switch 304. While facing the front side of the sharpener (e.g., FIG. 12C), the user grasps the handle of the knife, places the blade into a selected guide slot (e.g., slot 312) so that the cutting edge rests on the bottom edge surface (e.g., edge surface 316) and the side of the blade contacts the belt 306 (e.g., belt extent 308) nearest the handle. The configuration of the guide slot will ensure the desired tilt and bevel angles are maintained. The user withdraws the knife across the belt while maintaining contact with the edge surface. To the extent that the knife has a curvilinear cutting edge, the user may raise the handle during this backward stroke to maintain contact between the cutting edge and the edge guide surfaces 316.

The foregoing process may be repeated a suitable number of times, such as 3-5 times. This applies a primary sharpening operation to one side of the knife. The user then places the knife in the other slot (e.g., slot 314) and repeats. This completes the primary sharpening operation to the other side of the knife, producing a sharpened cutting edge. The tilt angle configuration of the sharpener will provide enhanced surface pressure and MTO control, and tip rounding will be avoided.

Continuing with FIGS. 12A-12D, a leg portion of the housing 302 is generally represented at 320. This leg portion 320 extends from the main body of the housing to support a secondary abrasive member 322. The secondary abrasive member 322 is comprises a stationary ceramic abrasive rod, although other forms of abrasive members can be used. The abrasive rod 322 is tapered and is disposed at a selected angle with respect to horizontal (in this case, about 30 degrees). Guide surfaces 324, 326 are disposed at each end of the rod 322. The tapered shape allows large or small serrations to be individually sharpened as desired.

In some cases, the user may elect to perform a secondary sharpening operation upon the knife using the abrasive rod. This is carried out by placing the side of the blade against a selected one of the guide surfaces (such as the surface 324) to establish a desired orientation angle of the blade with respect to the rod 322. Once oriented, the user advances the blade along the rod while retracting the cutting edge thereacross, maintaining the angular orientation established by the guide surface. This can be repeated a number of times, such as 3-5 times, after which the process may be repeated using the other guide surface (e.g., surface 326). This applies a secondary honing operation to further sharpen the knife. In this way, the sharpening applied against the rod 322 is similar to sharpening applied using a steel-type sharpener.

In some cases, the primary sharpening angle applied to the blade by the belt 306 may be a first value, such as nominally 20 degrees, and the secondary sharpening angle applied to the blade by the rod 322 may be a second value, such as nominally 25 degrees. This allows the blade to be configured with a micro-beveled geometry to enhance sharpness and durability. Touch up sharpening may be applied using just the ceramic rod 322 as desired. Sharpening may be applied by the belt without the use of the ceramic rod.

Figure 13A:
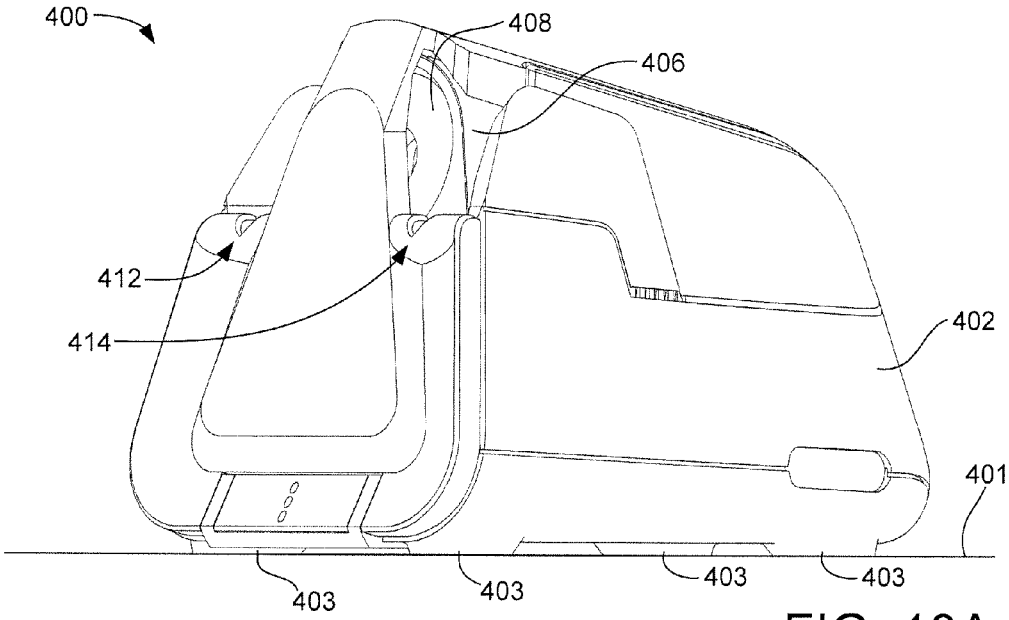
FIGS. 13A through 13B show various views of a tilted angle abrasive belt sharpener similar to the sharpener of FIG. 12A-12D in accordance with further embodiments.
Figure 13B:
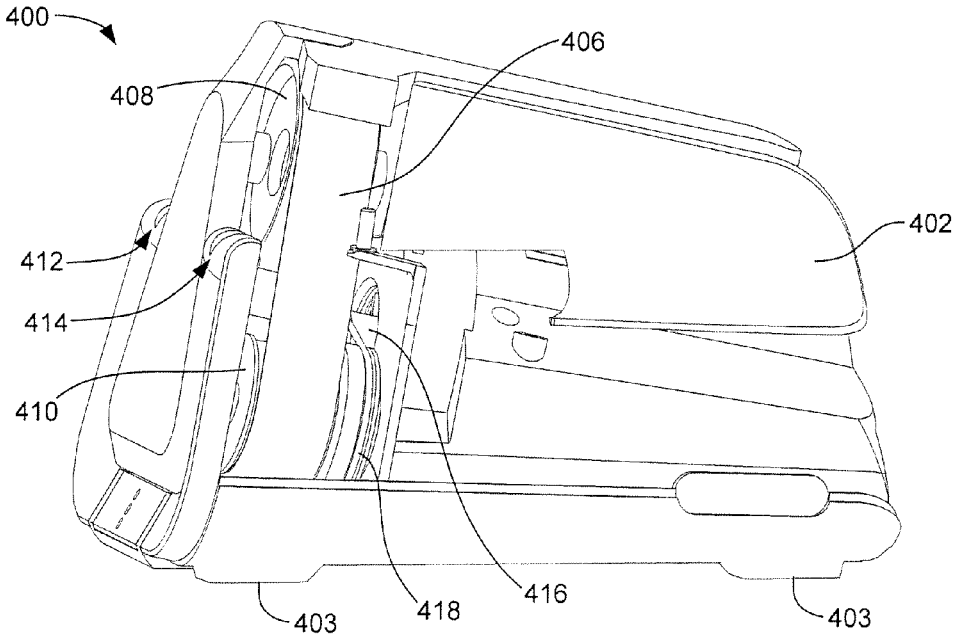

FIGS. 13A and 13B show yet another tilt angle abrasive belt sharpener 400 in accordance with some embodiments. The sharpener 400 is similar to the sharpener 300 discussed above. FIG. 13A is an isometric view of the sharpener 400 from one vantage point, and FIG. 13B is an isometric view of the sharpener 400 from another vantage point and is partially cutaway to show selected interior components of interest.

As with the sharpener 300, the sharpener 400 is a powered sharpener configured to rest on a horizontal base surface 401 during operation. Generally, an endless abrasive belt is driven along a triangular belt path over three internally disposed rollers that are parallel with each other and are each tilted forward at a selected non-orthogonal angle with respect to the horizontal direction. An internal motor rotates the belt along the belt path, and includes an output drive shaft that is parallel to the roller axes and non-parallel to the horizontal direction. Guide slots are arranged with stationary, horizontal edge guide surfaces to provide non-orthogonal angles with respect to the belt roller axes.

With reference now to FIGS. 13A and 13B, a rigid housing 402 encloses various elements of interest such as the motor, transfer assembly, rollers, control electronics, etc. Base support contact features (e.g., pads) 403 extend from the housing 402 and are aligned along a horizontal plane to rest on the base surface 401.

An endless abrasive belt 406 is routed along a plurality of rollers, including rollers 408, 410. Opposing guide slots 412, 414 operate as before to enable a user to carry out modified slack-belt sharpening on opposing distal extents of the belt. An interior motor drive shaft 416 transfers rotational power to the drive roller 410 via a drive belt 418.

It will now be appreciated that the various embodiments presented herein can provide a number of benefits over the prior art. By providing a non-orthogonal alignment angle such as but not limited to those shown in FIGS. 3-10D, a differential deflection can be induced across the width of the belt with respect to the blade being sharpened. This provides a more uniform surface pressure and MTO rate against the side of the blade along the length thereof and tends to reduce increases of surface pressure at points along the cutting edge that experience relatively large amounts of variation of curvature, such as points adjacent the tip of the blade. As noted above, this non-orthogonal "tilt angle" belt sharpening can be carried out by enacting one or more of a tilt angle B (see e.g., FIGS. 4 and 7A-7B), a skew angle C (see e.g., FIGS. 8A-8B), and/or an offset/skewed support member (see e.g., FIGS. 9A-9B; 10A-10D; and 11A-11C).

In some embodiments, different belts having different abrasiveness levels and linear stiffness levels can be successively applied to the tool to provide a more complex sharpening process. For example and not by limitation, in one embodiment a first relatively stiffer, higher abrasive belt can be installed to provide a relatively coarse level of sharpening to the knife in which relatively more material is removed therefrom, followed by installation of a second, relatively less stiff belt with a more fine level of abrasive can be installed to provide a honing operation. The differences in stiffness can provide different levels of contour to the final blade geometry.

It is to be understood that even though numerous characteristics and advantages of various embodiments of the present disclosure have been set forth in the foregoing description, together with details of the structure and function of various embodiments, this detailed description is illustrative only, and changes may be made in detail, especially in matters of structure and arrangements of parts within the principles of the present disclosure to the full extent indicated by the broad general meaning of the terms in which the appended claims are expressed.

What is claimed is:

1. A sharpener for sharpening a cutting tool having a blade portion with a cutting edge affixed to a user handle, the sharpener comprising:

first and second rollers, the first roller rotatable about a first roller axis, the second roller rotatable about a second roller axis parallel to the first roller axis;

an endless abrasive belt arranged along a belt path that passes over the first and second rollers to define a planar segment that lies along a neutral plane from the first roller to the second roller; and a guide assembly adjacent the planar segment of the belt configured to contactingly engage the cutting edge of the cutting tool and apply a non-uniform surface pressure to a side of the cutting tool adjacent the cutting edge across a width of the belt so that a greater amount of surface pressure is applied by a portion of the belt adjacent a proximal end of the blade portion adjacent the user handle of the cutting tool and a lesser amount of surface pressure is applied by a portion of the belt adjacent a distal end of the blade portion opposite the user handle.

2. The sharpener of claim 1, wherein the guide assembly provides the greater amount of surface pressure by the portion of the belt adjacent the proximal end of the blade portion adjacent the user handle of the cutting tool and the lesser amount of surface pressure by the portion of the belt adjacent the distal end of the blade portion opposite the user handle by having a first edge guide surface adjacent a front edge of the belt configured to contactingly support a first portion of the cutting edge and a second edge guide surface adjacent an opposing rear edge of the belt configured to concurrently contactingly support a second portion of the cutting edge, wherein each of the first and second edge guide surfaces are the same selected distance from a horizontal plane, and wherein the first roller axis and the second roller axis are non-parallel to the horizontal plane.

3. The sharpener of claim 1, wherein the guide assembly provides the greater amount of surface pressure by the portion of the belt adjacent the proximal end of the blade portion adjacent the user handle of the cutting tool and the lesser amount of surface pressure by the portion of the belt adjacent the distal end of the blade portion opposite the user handle by having a side guide surface configured to support a side of the blade portion of the cutting tool along a plane that is outwardly skewed with respect to the neutral plane so that the distal end of the blade portion is farther away from the first roller axis than the proximal end of the blade portion.

4. The sharpener of claim 1, wherein the guide assembly provides the greater amount of surface pressure by the portion of the belt adjacent the proximal end of the blade portion adjacent the user handle of the cutting tool and the lesser amount of surface pressure by the portion of the belt adjacent the distal end of the blade portion opposite the user handle by a support member which contactingly engages a backing layer of the abrasive belt opposite the abrasive surface below the cutting tool between the first and second rollers.

5. The method of claim 4, wherein the support member is characterized as a rotatable roller that extends along a support roller axis non-parallel to the first and second roller axes, the backing layer support member deflecting a front edge of the belt adjacent the proximal end of the blade portion by a first distance away from the neutral plane and deflecting a rear edge of the belt adjacent the distal end of the blade portion by a smaller, second distance away from the neutral plane.

6. The sharpener of claim 1, wherein the guide assembly aligns the cutting edge at an angle that is non-parallel to the respective first roller axis and the second roller axis.

7. The sharpener of claim 1, wherein an intervening angle between the cutting edge and the first roller axis is less than 90 degrees.

8. The sharpener of claim 1, wherein the guide assembly comprises an edge guide surface adjacent the belt against which the user contactingly engages a portion of the cutting edge during a sharpening operation upon the cutting edge against the belt, and a side support surface in facing relation to the belt against which the user concurrently contactingly engages a side surface of the cutting tool during the sharpening operation.

9. The sharpener of claim 8, wherein the edge guide surface is a first edge guide surface adjacent a front edge of the belt, and the guide assembly further comprises a second edge guide surface adjacent a rear edge of the belt so that the belt extends between the respective first and second edge guide surfaces, the first and second edge guide surfaces aligned along a presentation line that is non-parallel with the first and second roller axes.

10. The sharpener of claim 1, wherein the guide assembly comprises a rotatable edge guide surface adjacent the belt against which the user contactingly engages a portion of the cutting edge during sharpening thereof, the rotatable edge guide surface forming a portion of an edge guide support roller rotatable about a roller axis that is orthogonal to the first roller axis.

11. The sharpener of claim 1, further comprising a housing configured to be supported by a horizontal base surface using a plurality of base support contact features aligned along a horizontal plane, wherein the first and second rollers and the endless abrasive belt are at least partially enclosed by the housing, the first and second roller axes are skewed with respect to the horizontal plane, and the guide assembly comprises an edge guide surface that is nominally parallel with the horizontal plane.

12. The sharpener of claim 11, wherein the edge guide surface is a first edge guide surface adjacent a front edge of the belt, wherein the guide assembly comprises a second edge guide surface adjacent a rear edge of the belt so that the belt extends between the first and second edge guide surfaces, and wherein each of the first and second edge guide surfaces are the same selected distance from the horizontal plane.

13. The sharpener of claim 1, further comprising a housing configured to be supported by a horizontal base surface using a plurality of base support contact features aligned along a horizontal plane, wherein the first and second rollers and the endless abrasive belt are at least partially enclosed by the housing, the first and second roller axes are nominally parallel with the horizontal plane, and the guide assembly comprises a guide surface configured to support the cutting tool during a sharpening operation.

14. The sharpener of claim 13, wherein the guide surface is a side surface configured to contactingly engage a side of the blade portion of the cutting tool, the side surface extending along a plane that is parallel to the first and second roller axes.

15. A sharpener for sharpening a cutting tool having a blade portion with a cutting edge, the sharpener comprising:

a housing with one or more contact features aligned along a horizontal plane to support the housing on a horizontal base surface;

first and second rollers at least partially disposed within the housing, the first roller rotatable about a first roller axis, the second roller rotatable about a second roller axis parallel to the first roller axis;

an endless abrasive belt at least partially disposed within the housing and arranged to be advanced by the first and second rollers along a belt path that includes a planar segment that lies along a neutral plane from the first roller to the second roller, the first and second rollers nonparallel to the horizontal plane so that the belt path is skewed with respect to the horizontal plane; and a guide assembly adjacent the planar segment of the belt and configured to support the cutting tool as the cutting edge is presented against the abrasive belt along the planar segment between the first and second rollers.

16. The sharpener of claim 15, wherein the guide assembly comprises a first edge guide surface adjacent a front edge of the belt configured to contactingly support a first portion of the cutting edge and a second edge guide surface adjacent an opposing rear edge of the belt configured to concurrently contactingly support a second portion of the cutting edge, wherein each of the first and second edge guide surfaces are the same selected distance from the horizontal plane.

17. The sharpener of claim 15, wherein the sharpener further comprises a third roller rotatable about a third roller axis parallel to the first and second axes and about which the belt path passes to form a second planar extent that lies along a second neutral plane from the first roller to the third roller, wherein the guide assembly is a first guide assembly disposed between the first and second rollers, and wherein the sharpener further comprises a second guide assembly disposed between the first and third rollers.

18. A sharpener for sharpening a cutting tool having a blade portion with a cutting edge, the sharpener comprising:

a housing with one or more contact features aligned along a horizontal plane to support the housing on a horizontal base surface;

first and second rollers at least partially disposed within the housing, the first roller rotatable about a first roller axis, the second roller rotatable about a second roller axis parallel to the first roller axis and parallel to the horizontal plane;

an endless abrasive belt at least partially disposed within the housing and arranged to be advanced by the first and second rollers along a belt path that includes a planar segment that lies along a neutral plane from the first roller to the second roller; and a guide assembly adjacent the planar segment of the belt and configured to support the cutting tool as the cutting edge is presented against the abrasive belt along the planar segment between the first and second rollers, the guide assembly comprising a side support surface configured to contactingly support a side of the blade of the cutting tool during sharpening of the cutting edge against the abrasive belt, the side support surface extending along a plane that is skewed with respect to the first and second roller axes.

19. The sharpener of claim 18, wherein the guide assembly further comprises an edge guide surface configured to contactingly support a portion of the cutting edge concurrently with the contacting support provided by the side support surface to the side of the blade during the sharpening of the cutting edge against the abrasive belt.

20. The sharpener of claim 18, wherein the endless abrasive belt comprises an outer abrasive layer supported by an inner backing layer, the backing layer configured to contactingly engage the first and second rollers during advancement of the belt, the abrasive layer configured to remove material from the cutting tool during a sharpening operation, the guide assembly comprising a backing layer support member which contactingly engages the backing layer opposite the cutting tool, the backing layer support member extending less than a full width of the belt so that the backing layer support member contacts a front edge of the belt and an opposing rear edge of the belt opposite the cutting tool remains unsupported.

* * * * *